US008584776B2

(12) United States Patent
Radford et al.

(10) Patent No.: US 8,584,776 B2
(45) Date of Patent: Nov. 19, 2013

(54) METHODS, SYSTEMS, AND TOOL ASSEMBLIES FOR DISTRIBUTING WEIGHT BETWEEN AN EARTH-BORING ROTARY DRILL BIT AND A REAMER DEVICE

(75) Inventors: Steven R. Radford, The Woodlands, TX (US); Mark E. Anderson, The Woodlands, TX (US); William C. Thompson, Bullard, TX (US); Jim R. Powers, Edmond, OK (US)

(73) Assignee: Baker Hughes Incorporated, Houston, TX (US)

( * ) Notice: Subject to any disclaimer, the term of this patent is extended or adjusted under 35 U.S.C. 154(b) by 596 days.

(21) Appl. No.: 12/696,735

(22) Filed: Jan. 29, 2010

(65) Prior Publication Data

US 2010/0193248 A1 Aug. 5, 2010

Related U.S. Application Data

(60) Provisional application No. 61/148,695, filed on Jan. 30, 2009.

(51) Int. Cl.
*E21B 10/26* (2006.01)

(52) U.S. Cl.
USPC ..... 175/385; 175/57; 175/344; 175/334

(58) Field of Classification Search
USPC ..... 175/327, 334, 385, 344, 335, 406, 263; 166/901
See application file for complete search history.

(56) References Cited

U.S. PATENT DOCUMENTS 3,368,075 A * 2/1968 Hutchinson et al. ..... 376/165
4,449,595 A * 5/1984 Holbert ..... 175/79
4,467,879 A * 8/1984 Burge ..... 175/325.4
5,495,899 A * 3/1996 Pastusek et al. ..... 175/57
5,497,842 A 3/1996 Pastusek et al.
5,649,604 A 7/1997 Fuller et al.
5,678,644 A * 10/1997 Fielder ..... 175/391
5,957,223 A 9/1999 Doster et al.
5,979,577 A 11/1999 Fielder
5,992,548 A * 11/1999 Silva et al. ..... 175/391
RE36,817 E 8/2000 Pastusek et al.
6,200,514 B1 3/2001 Meister
6,230,828 B1 * 5/2001 Beuershausen et al. ..... 175/431

(Continued)

OTHER PUBLICATIONS

Warren et al. "PDC Bits: What's Needed to Meet Tomorrow's Challenge" 1994, Society of Petroleum Engineers, SPE 27978.*

(Continued)

*Primary Examiner* — Jennifer H Gay
*Assistant Examiner* — Caroline Butcher
(74) *Attorney, Agent, or Firm* — TraskBritt

(57) ABSTRACT

Methods, systems, and tool assemblies for distributing weight between a bit and a reamer device are disclosed. For example, at least one of the drill bit and the reamer may be configured to selectively distribute a weight-on-bit between the drill bit and the reamer, such as within a predetermined range. Additionally, methods of drilling wellbores may include selectively distributing a weight-on-bit applied to a bottom hole assembly between a drill bit and a reamer of the bottom hole assembly. Also, a reamer may be configured to exhibit a first maximum rate-of-penetration into a relatively hard formation, and a drill bit may be configured to exhibit a second maximum rate-of-penetration into a relatively soft formation that is less than the first maximum rate-of-penetration.

35 Claims, 10 Drawing Sheets

(56) References Cited

U.S. PATENT DOCUMENTS

| | | | | |
|---|---|---|---|---|
| 6,269,893 | B1 | 8/2001 | Beaton et al. | |
| 6,298,930 | B1 * | 10/2001 | Sinor et al. | 175/428 |
| 6,332,503 | B1 | 12/2001 | Pessier et al. | |
| 6,340,064 | B2 | 1/2002 | Fielder et al. | |
| 6,427,792 | B1 * | 8/2002 | Roberts et al. | 175/431 |
| 6,460,631 | B2 | 10/2002 | Dykstra et al. | |
| 6,659,207 | B2 | 12/2003 | Hoffmaster et al. | |
| 6,711,969 | B2 * | 3/2004 | Meiners et al. | 76/108.2 |
| 6,729,420 | B2 * | 5/2004 | Mensa-Wilmot | 175/385 |
| 6,779,613 | B2 | 8/2004 | Dykstra et al. | |
| 6,920,944 | B2 | 7/2005 | Eppink et al. | |
| 6,935,441 | B2 | 8/2005 | Dykstra et al. | |
| 7,096,978 | B2 * | 8/2006 | Dykstra et al. | 175/57 |
| 7,316,277 | B2 * | 1/2008 | Jeffryes | 175/27 |
| 7,441,612 | B2 * | 10/2008 | Durairajan et al. | 175/431 |
| 7,562,725 | B1 * | 7/2009 | Broussard et al. | 175/93 |
| 8,006,785 | B2 * | 8/2011 | Oldham et al. | 175/402 |
| 8,074,741 | B2 * | 12/2011 | Meister | 175/57 |
| 2001/0040053 | A1 * | 11/2001 | Beuershausen | 175/57 |
| 2003/0178232 | A1 * | 9/2003 | Mensa-Wilmot | 175/385 |
| 2004/0074672 | A1 * | 4/2004 | Rives | 175/57 |
| 2004/0099448 | A1 * | 5/2004 | Fielder et al. | 175/385 |
| 2004/0222022 | A1 * | 11/2004 | Nevlud et al. | 175/57 |
| 2005/0089440 | A1 * | 4/2005 | Kembaiyan | 420/502 |
| 2005/0145417 | A1 * | 7/2005 | Radford et al. | 175/57 |
| 2005/0183892 | A1 * | 8/2005 | Oldham et al. | 175/402 |
| 2005/0211470 | A1 * | 9/2005 | Jeffryes | 175/27 |
| 2006/0162968 | A1 | 7/2006 | Durairajan et al. | |
| 2006/0167668 | A1 | 7/2006 | Cariveau et al. | |
| 2006/0167669 | A1 | 7/2006 | Cariveau et al. | |
| 2006/0180356 | A1 | 8/2006 | Durairajan et al. | |
| 2007/0093996 | A1 * | 4/2007 | Cariveau et al. | 703/7 |
| 2007/0151770 | A1 * | 7/2007 | Ganz | 175/426 |
| 2007/0192071 | A1 * | 8/2007 | Huang et al. | 703/2 |
| 2008/0105465 | A1 * | 5/2008 | Radford et al. | 175/57 |
| 2008/0128174 | A1 | 6/2008 | Radford et al. | |
| 2008/0128175 | A1 | 6/2008 | Radford et al. | |
| 2008/0223575 | A1 * | 9/2008 | Oldham et al. | 166/285 |
| 2009/0030658 | A1 | 1/2009 | Durairajan et al. | |
| 2009/0055135 | A1 * | 2/2009 | Tang et al. | 703/1 |
| 2009/0145669 | A1 * | 6/2009 | Durairajan et al. | 175/431 |
| 2009/0152018 | A1 | 6/2009 | Sani | |
| 2009/0266614 | A1 * | 10/2009 | Meister | 175/57 |
| 2010/0006341 | A1 * | 1/2010 | Downton | 175/61 |
| 2010/0276199 | A1 * | 11/2010 | Radford | 175/57 |
| 2010/0276201 | A1 * | 11/2010 | Makkar et al. | 175/57 |
| 2011/0005841 | A1 | 1/2011 | Wood et al. | |

OTHER PUBLICATIONS

Okewunmi et al. "BHA Selection and Drilling Practices to Successfully Drill and Underream Difficult Deepwater GOM Salt Section, a Case History" 2007, American Association of Drilling Engineers, AADE-07-NTCE-11.*

Radford et al., Novel Concentric Expandable Stabilizer Results in Increased Penetration Rates and Drilling Efficiency with Reduced Vibration, International Association of Drilling Contractors, SPE/IADC 119534, Drilling Conference and Exhibition held in Amsterdam, The Netherlands, Mar. 17-19, 2009 (13 pages).

Thomson et al., A Systematic Approach to a Better Understanding of the Concentric Hole-Opening Process Utilizing Drilling Mechanics and Drilling Dynamics Measurements Recorded Above and Below the Reamer, IADC/SPE 112647 Drilling Conference held in Orlando, Florida, Mar. 4-6, 2008 (20 pages).

Written Opinion of the International Searching Authority for International Application No. PCT/US2009/041526 dated Jan. 19, 2010, 6 pages.

International Search Report for International Application No. PCT/US2009/041526 dated Jan. 19, 2010, 4 pages.

Written Opinion of the International Searching Authority for International Application No. PCT/US2010/022540 dated Jun. 16, 2010, 3 pages.

International Search Report for International Application No. PCT/US2010/022540 dated Jun. 16, 2010, 3 pages.

* cited by examiner

METHODS, SYSTEMS, AND TOOL ASSEMBLIES FOR DISTRIBUTING WEIGHT BETWEEN AN EARTH-BORING ROTARY DRILL BIT AND A REAMER DEVICE

CROSS-REFERENCE TO RELATED APPLICATION

This application claims the benefit of U.S. Provisional Patent Application Ser. No. 61/148,695, filed Jan. 30, 2009, the disclosure of which is hereby incorporated herein in its entirety by this reference.

TECHNICAL FIELD

Embodiments of the present invention relate to methods, systems, and tool assemblies for forming wellbores in subterranean earth formations and, more specifically, to methods, systems, and tool assemblies for forming wellbores in subterranean earth formations using an earth-boring rotary drill bit operating in conjunction with a reamer device for enlarging a diameter of a wellbore created by the earth-boring rotary drill bit.

BACKGROUND

Wellbores are formed in subterranean formations for various purposes including, for example, the extraction of oil and gas from a subterranean formation and the extraction of geothermal heat from a subterranean formation. A wellbore may be formed in a subterranean formation using a drill bit, such as, for example, an earth-boring rotary drill bit. Different types of earth-boring rotary drill bits are known in the art, including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). Earth-boring rotary drill bit are rotated and advanced into a subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through an annular space between the outer surface of the drill string and the exposed surface of the formation within the wellbore.

It is known in the art to use what is referred to in the art as a "reamer" device (also referred to in the art as a "hole opening device" or a "hole opener") in conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advance into the formation, the reamer device follows the drill bit through the pilot bore and enlarges the diameter of, or "reams," the pilot bore.

As a wellbore is being drilled in a formation, axial force or "weight" is applied to the drill bit (and reamer device, if used) to cause the drill bit to advance into the formation as the drill bit forms the wellbore therein. This force or weight is referred to in the art as the "weight-on-bit" (WOB). When using a reamer device in conjunction with a drill bit, the weight-on-bit is distributed between the drill bit and the reamer device, as both the drill bit and the reamer device contact uncut portions of the formation or formations being drilled. Therefore, as used herein, the term "weigh-on-bit," when used in conjunction with a drilling system or tool assembly including both a pilot bit and a reamer device, means the sum of the weight on the pilot bit and the weight on the reamer device.

A wellbore may, and typically does, extend through different formations or layers of geological material. The different formations may exhibit different physical properties. For example, some formations are relatively soft and are easily drilled through, while others are relatively hard and difficult to drill through. As a wellbore is drilled through a relatively hard formation and into an underlying softer formation using a bottom hole assembly that includes a drill bit and a reamer device longitudinally above the drill bit in the bottom hole assembly, the drill bit will quickly remove material from the softer formation while the reamer continues to more slowly ream out the wellbore in the harder formation. In such situations, the rate of penetration (ROP) of the reamer in the hard formation may be lower than the maximum potential rate of penetration at which the drill bit is capable of advancing into the lower, softer formation. As a result, the rate of penetration of the bottom hole assembly is limited by the rate of penetration of the reamer device, and the drill bit may begin to drill out the underlying, softer formation material without advancing into the formation at a rate sufficient to maintain a consistent, desired depth of cut (DOC) by the cutting structures of the drill bit. Consequently, the weight-on-bit applied to the bottom hole assembly may become undesirably unevenly distributed or proportioned between the reamer and the drill bit such that all or at least a majority of the weight-on-bit is applied to the reamer device and the portion of the bottom hole assembly distal to the reamer device rotates without sufficient weight-on-bit. Undesirable, and potentially damaging, vibrations in the bottom hole assembly and/or drill string may occur as a result of such an undesirable distribution of the weight-on-bit between the reamer and the drill bit.

BRIEF SUMMARY

In some embodiments, drilling tool assemblies, such as in the form of bottom hole assemblies, may comprise a pilot drill bit and a reamer device for reaming a pilot bore drilled by the pilot drill bit. The pilot drill bit and the reamer device may be configured to distribute a weight-on-bit (WOB) to be applied to the bottom hole assembly between the pilot drill bit and the reamer device in such a manner as to maintain a ratio of the portion of the weight-on-bit to be applied to the reamer device to a portion of the weight-on-bit to be applied to the pilot drill bit within a predetermined range.

In additional embodiments, methods of drilling wellbores in subterranean formations may comprise drilling through a first relatively harder formation material and into a second relatively softer formation material using a pilot drill bit of a bottom hole assembly to form a pilot bore, and reaming the pilot bore in the first relatively harder formation using a reamer device of the bottom hole assembly while the pilot drill bit continues to drill into the second relatively softer formation material. The methods may further include selectively distributing a weight-on-bit applied to the bottom hole assembly between the pilot drill bit and the reamer device.

In further embodiments, methods of drilling wellbores in subterranean formations may comprise configuring a reamer device of a bottom hole assembly to exhibit a first maximum rate-of-penetration into a first relatively harder formation material when a selected weight-on-bit and a selected torque are applied to the bottom hole assembly. The methods may further comprise configuring a pilot drill bit of the bottom hole assembly to exhibit a second maximum rate-of-penetration into a second relatively softer formation material when the selected weight-on-bit and the selected torque are applied to the bottom hole assembly. Additionally, the second maximum rate-of-penetration may be less than the first maximum rate-of-penetration. Furthermore, the bottom hole assembly may be positioned in the wellbore and the selected weight-on-bit and the selected torque may be applied to the bottom hole assembly. The methods may also include drilling pilot bore through the first relatively harder formation material and into the second relatively softer formation material using the pilot drill bit of the bottom hole assembly. Additionally, the pilot bore may reamed in the first relatively harder formation with the reamer device of the bottom hole assembly while the pilot drill bit continues to drill into the second relatively softer formation material.

DETAILED DESCRIPTION

Figure 1:
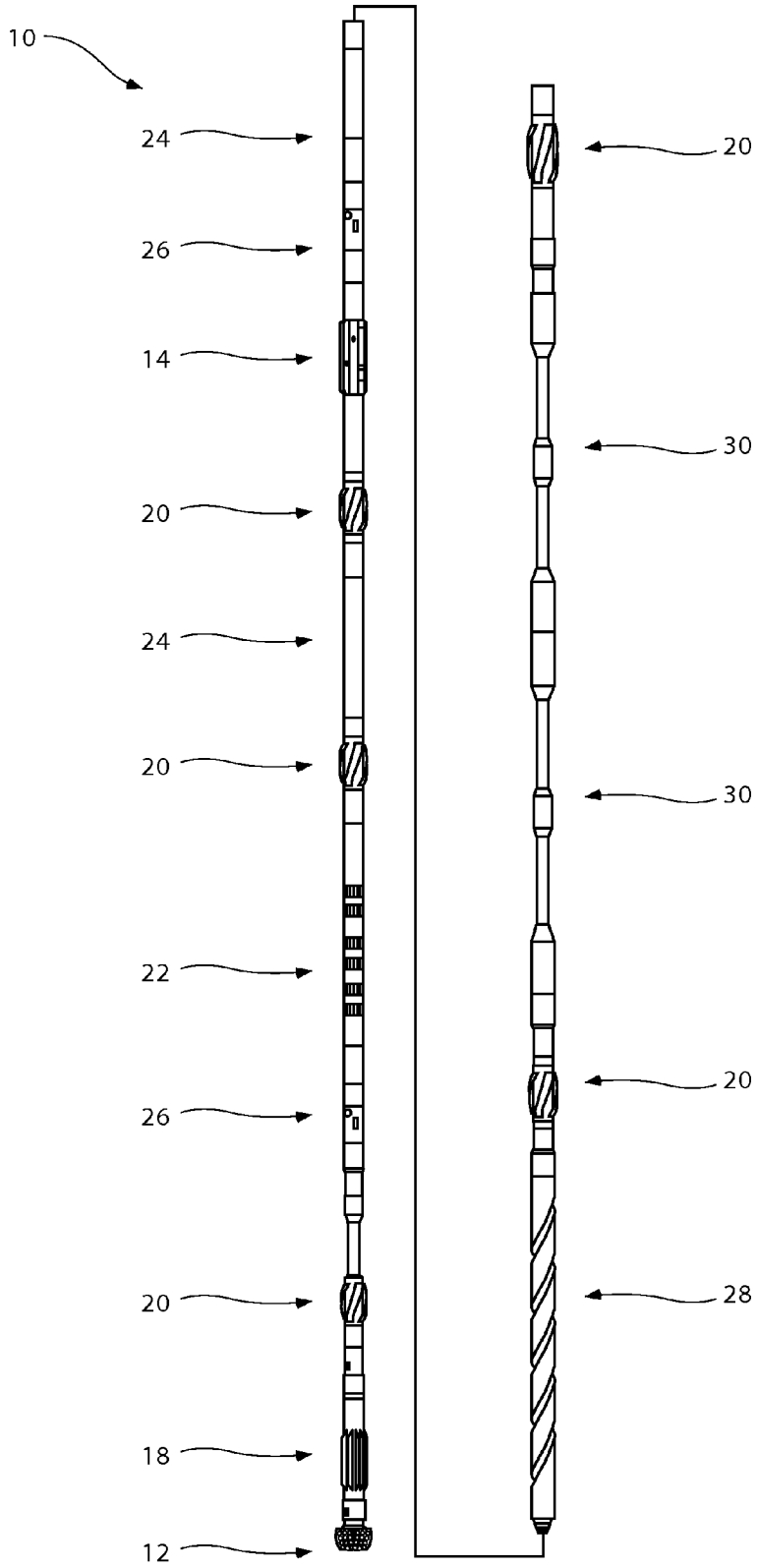
FIG. 1 illustrates an embodiment of a bottom hole assembly of the present invention.

The illustrations presented herein are not actual views of any particular drilling system, drilling tool assembly, or component of such an assembly, but are merely idealized representations that are employed to describe particular embodiments.

Some embodiments may be utilized to maintain desirable distributions of weight-on-bit (WOB) between a pilot drill bit and a reamer device of a bottom hole assembly as the bottom hole assembly is advanced through different types of subterranean formations in an effort to reduce or minimize undesirable vibrations in the bottom hole assembly and/or drill string.

Drill bits and reamer devices in embodiments of bottom hole assemblies and drilling systems may be configured such that the ratio of the portion of a weight-on-bit applied to the reamer device and the portion of the weight-on-bit applied to the drill bit is maintained at least substantially within a desirable range of ratios as the drill bits and reamers are advanced through homogenous formations as well as through different formations or layers of geological material (e.g., from a relatively hard formation into a relatively soft formation). By way of example and not limitation, drill bits and reamer devices in embodiments of bottom hole assemblies and drilling systems may be configured such that the ratio of the portion of a weight-on-bit applied to the reamer device to the portion of the weight-on-bit applied to the drill bit is maintained at about 0.5:1 or less. In other words, the portion of a weight-on-bit applied to a reamer device may be about fifty percent (50%) or less of a portion of the weight-on-bit applied to the pilot drill bit. More particularly, the ratio of the portion of a weight-on-bit applied to the reamer device to the portion of the weight-on-bit applied to the drill bit may be maintained between about 0.1:1 and about 0.4:1 as the drill bits and reamers are advanced through homogenous formations as well as through different formations or layers of geological material.

By way of example and not limitation, in some embodiments, the average exposure of the cutters (i.e., the theoretical maximum average depth of cut (DOC) of the cutters) on each of the drill bit and the reamer device may be selectively tailored such that the ratio of the portion of a weight-on-bit applied to the reamer device and the portion of the weight-on-bit applied to the drill bit is at least substantially maintained at a consistent value or within a range of values as the bottom hole assembly is advanced through a homogenous formation as well as through different formations or layers of geological material (e.g., from a relatively hard formation into a relatively soft formation).

For example, a plurality of cutters fixedly attached to the pilot drill bit may be sized and configured to exhibit a first average exposure, and a plurality of cutters fixedly attached to a reamer device utilized in conjunction with the pilot drill bit may be sized and configured to exhibit a second average exposure that is greater than about 1.2 times the first average exposure. In some embodiments, the second average exposure is greater than about 1.5 times the first average exposure.

The average exposure of the cutters on each of the pilot drill bit and the reamer device may be selectively tailored by, for example, positioning and orienting the cutting elements on the pilot drill bit such that they project by selected distances from the portions of the face (e.g., blades or rolling cones) of the pilot drill bit to which they are mounted, and/or positioning and orienting the cutting elements on the reamer device such that they project by selected distances from portions of the face (e.g., blades or rolling cones) of the reamer device. In additional embodiments, the average exposure of the cutters on each of the pilot drill bit and the reamer device may be selectively tailored by, for example, providing bearing structures or features on the face of one or both of the pilot drill bit and the reamer device that are configured to limit the depth-of-cut of the cutters thereon to a predetermined maximum depth-of-cut. Such bearing structures or features are also referred to herein and in the art as "depth-of-cut control" (DOCC) features.

In some embodiments, the average exposure of the cutting elements on the pilot drill bit may be reduced relative to the average exposure of the cutting elements on the reamer device, and the pilot drill bit may exhibit an aggressiveness that is reduced relative to the aggressiveness of the reamer device. Thus, the pilot drill bit may be prevented from out-drilling the reamer device in terms of respective rates of penetration (ROP), thus preventing the pilot drill bit from "drilling-off" and rotating within the wellbore while insufficient weight-on-bit is being applied to the pilot bit.

As a non-limiting example, the aggressiveness of one or more of the pilot drill bit and reamer device may also be selectively tailored by changing one or more variable features, such as the orientation of the cutters (e.g., the back rake angle), the cutter sizes (e.g., the cutter diameter), the cutter spacing (e.g., the distance between cutters on a blade), the number of cutters, the sharpness (e.g., chamfer, edge roundness, corner angle, edge geometry) of the cutters, the size and placement of the bearing surfaces (e.g., the number, size and position relative to the cutters of DOCC features), the number of blades, the relative rotational speeds (i.e., angular velocity, rotations per minute (RPM)) while drilling, the bit type (e.g., rolling-cutter, drag, hybrid, etc.), and combinations thereof.

In some embodiments, the relative aggressiveness of a pilot drill bit and reamer device may be selectively tailored by the relative orientation of the cutters, such as the relative back rake angle of the cutters. A specific cutter may be made less aggressive by increasing the back rake angle of the cutter. By increasing the average back rake angle of the cutters of a pilot drill bit, the relative aggressiveness of the pilot drill bit may be reduced. Conversely, by decreasing the average back rake angle of the cutters, the relative aggressiveness may be increased. In view of this, a reamer device may be paired with and utilized with a pilot drill bit that comprises cutters having an average back rake angle that is greater than an average back rake angle of the cutters of the reamer device. Furthermore, the degree of difference in average back rake angles between the cutters of the reamer device and the cutters of the pilot drill bit may be selectively tailored, along with other variable features, to achieve a desired relative aggressiveness.

In other embodiments, the relative aggressiveness of a pilot drill bit and reamer device may be selectively tailored by modifying the relative cutter sizes. By reducing the average cutter size of a pilot drill bit the relative aggressiveness of the pilot drill bit may be reduced. Conversely, by increasing the average cutter size, the relative aggressiveness may be increased. In view of this, a reamer device may be paired with and utilized with a pilot drill bit that comprises cutters having an average size that is less than an average size of the cutters of the reamer device. Furthermore, the degree of difference in the average size between the cutters of the reamer device and the cutters of the pilot drill bit may be selectively tailored, along with other variable features, to achieve a desired relative aggressiveness.

In further embodiments, the relative aggressiveness of a pilot drill bit and reamer device may be selectively tailored by modifying the relative cutter spacing or the relative number of cutters. By increasing the number of cutters of a pilot drill bit the relative aggressiveness of the pilot drill bit may be reduced. Conversely, by decreasing the number of cutters, the relative aggressiveness may be increased. In view of this, a reamer device may be paired with and utilized with a pilot drill bit that comprises more cutters per unit of projected area relative the reamer device. Furthermore, the degree of difference in the number of cutters per unit of projected area between the reamer device and the pilot drill bit may be selectively tailored, along with other variable features, to achieve a desired relative aggressiveness.

In further embodiments, the relative aggressiveness of a pilot drill bit and reamer device may be selectively tailored by the relative sharpness of the cutters, such as the relative chamfer size or edge roundness. A specific cutter may be made less aggressive by increasing the chamfer size or edge roundness of the cutter. By increasing the average chamfer size or edge roundness of the cutters of a pilot drill bit the relative aggressiveness of the pilot drill bit may be reduced. Conversely, by decreasing the average chamfer size or edge roundness of the cutters, the relative aggressiveness may be increased. In view of this, a reamer device may be paired with and utilized with a pilot drill bit that comprises cutters having an average chamfer size or edge roundness that is greater than an average chamfer size or edge roundness of the cutters of the reamer device. Furthermore, the degree of difference in average chamfer size or edge roundness between the cutters of the reamer device and the cutters of the pilot drill bit may be selectively tailored, along with other variable features, to achieve a desired relative aggressiveness. However, the effect of initial chamfer size or edge roundness of the cutters may have a reduced effect on relative aggressiveness as the cutters are used and exposed to wear, which may change the edge geometry of the cutters.

In additional embodiments, the relative aggressiveness of a pilot drill bit and reamer device may be selectively tailored by modifying the size and position of the bearing surfaces (e.g., the number, size and position relative to the cutters of DOCC features). For example, by increasing the size of the bearing surfaces of a pilot drill bit or the relative aggressiveness of the pilot drill bit may be reduced, especially at higher weight-on-bit. Conversely, by size of the bearing surfaces, the relative aggressiveness may be increased. In view of this, a reamer device may be paired with and utilized with a pilot drill bit that comprises a bearing surface that makes up a larger percentage of the pilot drill bits projected surface area than the reamer device. Furthermore, the degree of difference in the percentage of projected area that is bearing surface of the reamer device and the pilot drill bit may be selectively tailored, along with other variable features, to achieve a desired relative aggressiveness.

In further embodiments, the relative aggressiveness of a pilot drill bit and reamer device may be selectively tailored by modifying the relative number of blades. By increasing the number of blades of a pilot drill bit the relative aggressiveness of the pilot drill bit may be reduced. Conversely, by decreasing the number of blades, the relative aggressiveness may be increased. In view of this, a reamer device may be paired with and utilized with a pilot drill bit that comprises more blades than the reamer device. Furthermore, the difference in the number of blades of the reamer device and the pilot drill bit may be selectively tailored, along with other variable features, to achieve a desired relative aggressiveness.

In yet additional embodiments, the relative aggressiveness of a pilot drill bit and reamer device may be selectively tailored by modifying their relative rotational speeds (i.e., angular velocity, rotations per minute (RPM)) while drilling, such as with a downhole motor positioned between the pilot drill bit and reamer device. The amount of rubbing experienced by a pilot drill bit at a particular DOC may be increased by reducing the rotational speed. In view of this, by decreasing the rotational speed of a pilot drill bit the relative aggressiveness of the pilot drill bit may be reduced. Conversely, by increasing the rotational speed, the relative aggressiveness may be increased. In view of this, a reamer device may be paired with and utilized with a pilot drill bit that is operated at a relatively slower rotational speed than the reamer device. Furthermore, the difference in rotational speeds of the reamer device and the pilot drill bit may be selectively tailored, along with other variable features, to achieve a desired relative aggressiveness.

In yet further embodiments, the relative aggressiveness of a pilot drill bit and reamer device may be selectively tailored by selecting the aggressiveness of the bit type. For example, a rolling-cutter bit may be less aggressive than a hybrid bit, and a hybrid bit may be less aggressive than a drag bit. In view of this, a drag-type reamer device may be paired with and utilized with a rolling-cutter or hybrid-type pilot drill bit. Furthermore, the combination of pilot drill bit and reamer device types may be selectively tailored, along with other variable features, to achieve a desired relative aggressiveness.

In some embodiments, the ratio of the portion of a weight-on-bit applied to the reamer device to the portion of the weight-on-bit applied to the pilot drill bit may be maintained at least substantially constant, or within a predetermined range of values, as the pilot drill bits and reamers are advanced through homogenous formations as well as from within a first formation material exhibiting a first average unconfined compressive strength into a second formation material exhibiting a second average unconfined compressive strength that is less than about 80% of the first average unconfined compressive strength. More particularly, the ratio of the portion of a weight-on-bit applied to the reamer device to the portion of the weight-on-bit applied to the pilot drill bit may be maintained at least substantially constant, or within a predetermined range of values, as the pilot drill bits and reamers are advanced through homogenous formations as well as from within a first formation material exhibiting a first average unconfined compressive strength into a second formation material exhibiting a second average unconfined compressive strength that is less than about 50% of the first average unconfined compressive strength. For example, the distribution of the weight-on-bit between a pilot drill bit and a reamer device of a bottom hole assembly may be maintained by utilizing a pilot drill bit and reamer device combination wherein the reamer device is more aggressive than the pilot drill bit.

Embodiments of the drilling systems and tool assemblies (e.g., bottom hole assemblies) may comprise any type of pilot drill bit and any type of reamer device that may be selectively configured to maintain a desirable ratio of the portion of a weight-on-bit applied to the reamer device to the portion of the weight-on-bit applied to the pilot drill bit, as previously described. For example, the pilot drill bit may comprise a fixed-cutter drill bit, a rolling-cutter drill bit (e.g., a roller-cone bit), a diamond-impregnated drill bit, or a hybrid drill bit including both fixed cutters and rolling cutters. The reamers may comprise a reamer having fixed blades or wings on which cutters are fixedly attached or a reamer having movable (e.g., expandable) blades or wings on which cutters are fixedly attached. The reamers also may comprise diamond-impregnated cutting blades or segments, rolling cutters, or combinations of such cutting structures.

FIG. 1 illustrates an embodiment of a bottom hole assembly 10. The bottom hole assembly 10 includes a pilot drill bit 12 and a reamer device 14. The bottom hole assembly 10, optionally, may include various other types of drilling tools, such as, for example, a steering unit 18, one or more stabilizers 20, a measurement while drilling (MWD) tool 22, one or more bi-directional communications pulse modules (BCPM) 24, one or more mechanics and dynamics tools 26, one or more drill collars 28, and one or more heavy weight drill pipe (HWDP) segments 30. The bottom hole assembly 10 may be rotated within a wellbore by, for example, rotating a drill string to which the bottom hole assembly 10 is attached from the surface of the formation, or a down-hole hydraulic motor may be positioned above the bottom hole assembly 10 in the drill string and used to rotate the bottom hole assembly 10.

The pilot drill bit 12 of the bottom hole assembly 10 may comprise, for example, a depth-of-cut controlled fixed-cutter earth-boring rotary drill bit or a drill bit including a depth-of-cut control feature as disclosed in at least one of U.S. Pat. No. 6,298,930 to Sinor et al. and U.S. Pat. No. 6,460,631 to Dykstra et al., the disclosures of each of which is incorporated by reference herein in its entirety.

Figure 2:
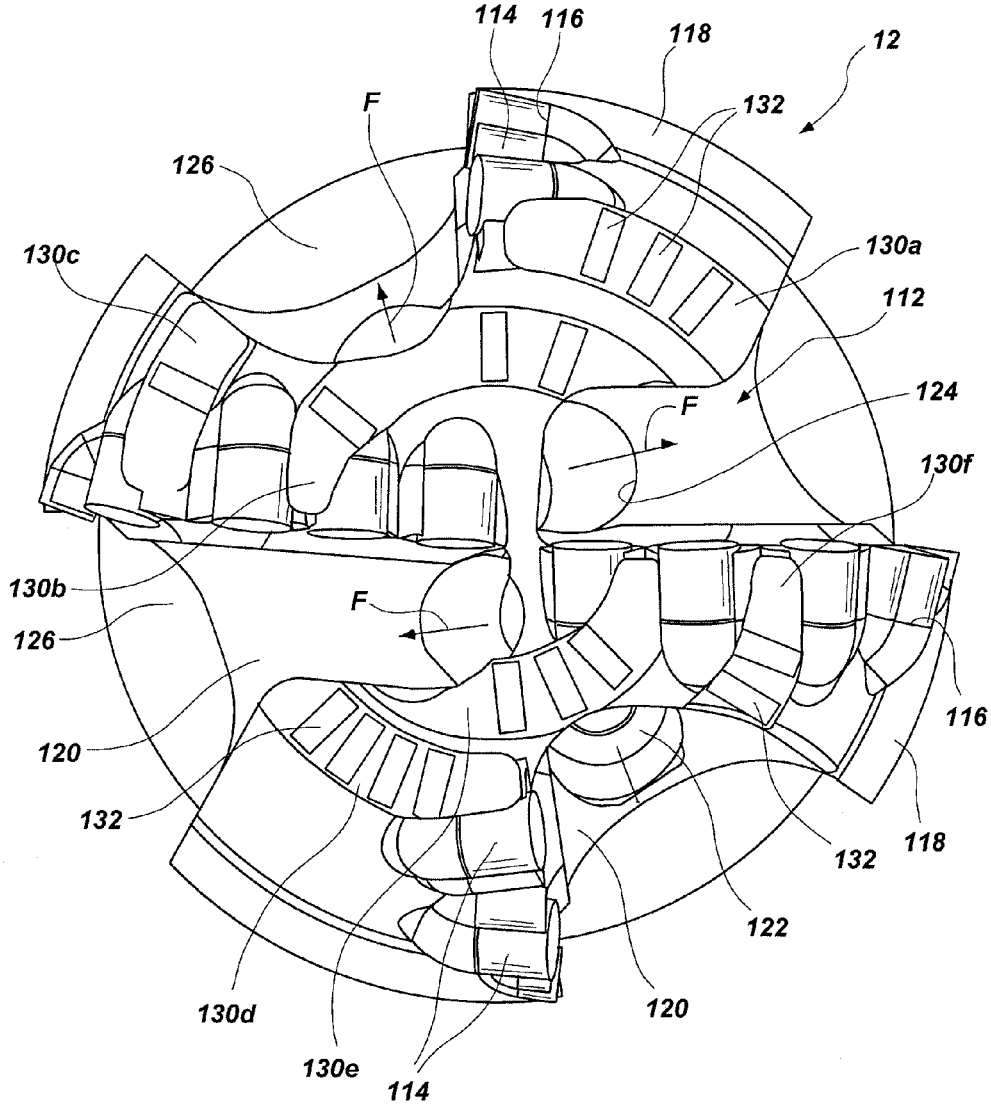
FIG. 2 is a plan view of a face of an embodiment of a pilot drill bit that may be used as part of the bottom hole assembly of FIG. 1.
Figure 3:
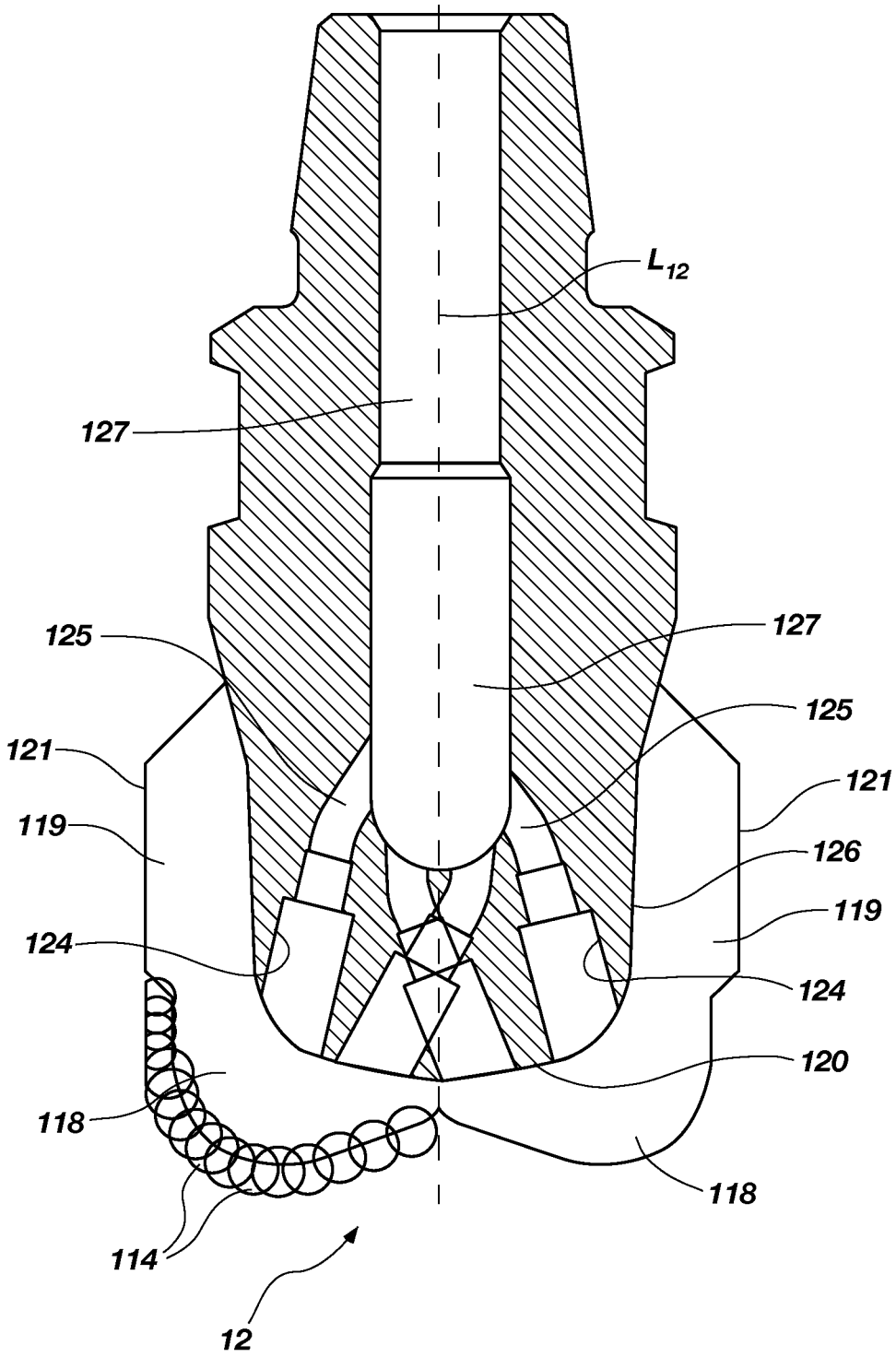
FIG. 3 is a longitudinal cross-sectional view of the pilot drill bit shown in FIG. 2.

One non-limiting example of an embodiment of the pilot drill bit 12 is shown in FIGS. 2 and 3. FIG. 2 is a plan view of a face 112 of the pilot drill bit 12, and FIG. 3 is a longitudinal cross-sectional view of the pilot drill bit 12.

Referring to FIG. 2, the pilot drill bit 12 includes a plurality of polycrystalline diamond compact (PDC) cutters 114 bonded by their substrates (diamond tables and substrates not shown separately for clarity), as by brazing, into pockets 116 in wings or blades 118 that extend radially outward and longitudinally downward from the center of the pilot drill bit 12. Fluid courses 120 are disposed between the blades 118 and may direct the course of drilling fluid that flows out from the pilot drill bit 12 through fluid nozzles 122 secured in nozzle orifices 124. As shown in FIG. 3, the nozzle orifices 124 are located at the end of fluid passages 125 leading from a plenum 127 that extends partially through the body of the pilot drill bit 12. The fluid courses 120 (FIGS. 2 and 3) extend to junk slots 126 (FIG. 3) extending upwardly along the side of the pilot drill bit 12 between the blades 118. As shown in FIG. 3, gage pads 119 comprise longitudinally upward extensions of the blades 118 and may have wear-resistant inserts or coatings on radially outer surfaces 121 of the gage pads 119, as known in the art. Formation cuttings are swept away from the cutters 114 by drilling fluid F emanating from the nozzle orifices 124, the fluid moving generally radially outwardly through fluid courses 120 and then upwardly through junk slots 126 to an annulus between the drill string from which the pilot drill bit 12 is suspended, and onto the surface of the formation.

As previously mentioned, the pilot drill bit 12 may employ depth-of-cut control (DOCC) features, which reduce, or limit, the extent in which the cutters 114 or other types of cutters or cutting elements are exposed on the bit face 112, on the blades 118, or as otherwise positioned on the pilot drill bit 12. The DOCC features may provide a bearing surface or area on which the pilot drill bit 12 may ride while the cutters 114 of the pilot drill bit 12 are engaged with the formation to their maximum average depth-of-cut, which may be defined as the average of the distances each of the cutters 114 extends into the formation when the DOCC features are riding on the formation. Stated another way, the standoff of the cutters 114 is at least substantially controlled by the effective amount of exposure of the cutters 114 above the surface, or surfaces, surrounding each cutter 114.

The pilot drill bit 12 may be constructed so as to limit the exposure of at least some of the cutters 114 on the pilot drill bit 12 such that the average depth-of-cut of the cutters 114 is limited to a predetermined maximum average depth-of-cut. The DOCC features of the pilot drill bit 12 may be used to limit the depth-of-cut of the pilot drill bit 12 to a selected or predetermined level or magnitude by distributing the load attributable to the applied weight-on-bit over a sufficient surface area on the bit face 112, blades 118 or other bit body structure contacting the formation at the bottom of the wellbore. Stated another way, the DOCC features of the pilot drill bit 12 limit the unit volume of formation material (rock) removed per bit rotation to prevent the pilot drill bit 12 from out drilling the reamer device 14.

As shown in FIG. 2, a plurality of the DOCC features, each comprising an arcuate bearing segment 130*a* through 130*f*, may reside on, and in some instances bridge between, the blades 118. Specifically, the bearing segments 130*b* and 130*e* may each reside partially on an adjacent blade 118 and extends therebetween. Each of the arcuate bearing segments 130*a* through 130*f* may lie along substantially the same radius from the bit centerline as a cutter 114 rotationally trailing that bearing segment 130. The arcuate bearing segments 130*a* through 130*f* together may provide sufficient surface area to withstand the axial or longitudinal weight-on-bit applied to the pilot drill bit 12, so that the depth-of-cut and/or rate of penetration of the pilot drill bit 12 may be selectively controlled.

As can be seen in FIG. 2, wear-resistant elements or inserts 132, such as in the form of tungsten carbide bricks or discs, pressed tungsten carbide inserts, diamond grit, diamond film, natural or synthetic diamond, or cubic boron nitride, may be added to the exterior bearing surfaces of bearing segments 130 to reduce the abrasive wear thereof by contact with the formation. In additional embodiments, the bearing surfaces may be at least partially covered with a wear-resistant hardfacing material.

Figure 4:
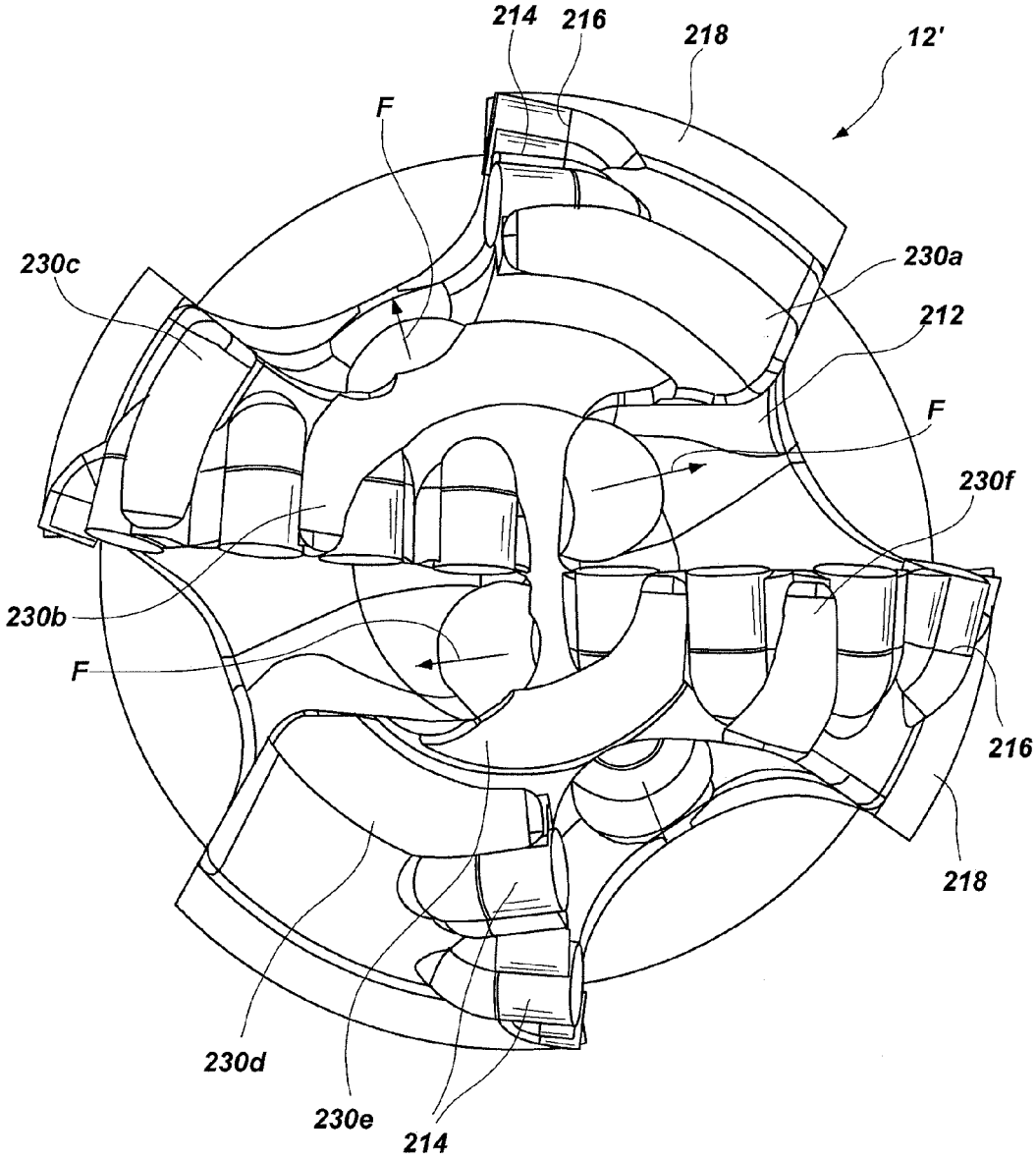
FIG. 4 is a plan view of a face of another embodiment of a pilot drill bit that may be used as part of the bottom hole assembly of FIG. 1.

FIG. 4 depicts another embodiment of a rotary pilot drill bit 12' that may be used in the bottom hole assembly 10 of FIG. 1. The rotary pilot drill bit 12' is shown in FIG. 4 looking upwardly at its face 212 as if the viewer were positioned at the bottom of a wellbore. Pilot drill bit 12' includes a plurality of cutters 214 bonded by their substrates (diamond tables and substrates not shown separately for clarity), as by brazing, into pockets 216 in blades 218 extending above the face 212 of the pilot drill bit 12'. Cutters 214 also may be press-fit or shrink-fit into the pockets 216, or an adhesive may be used to secure the cutters 214 within the pockets 216.

A plurality of the DOCC features, each comprising an arcuate bearing segment 230*a* through 230*f*, reside on, and in some instances bridge between, blades 218. Specifically, bearing segments 230*b* and 230*e* each reside partially on an adjacent blade 218 and extend therebetween. The arcuate bearing segments 230*a* through 230*f*, each of which lies substantially along the same radius from the bit centerline as a cutter 214 rotationally trailing that bearing segment 230, together provide sufficient surface area to limit a depth-of-cut of the cutters 214 into a formation to a predetermined maximum depth-of-cut.

While the pilot drill bit 12' of FIG. 4 is similar to the pilot drill bit 12 of FIGS. 2 and 3, the pilot drill bit 12' does not include inserts 132 in the arcuate bearing segments 230*a* through 230*f*. Such an arrangement may be suitable for less abrasive formations where wear is of lesser concern.

Figure 8:
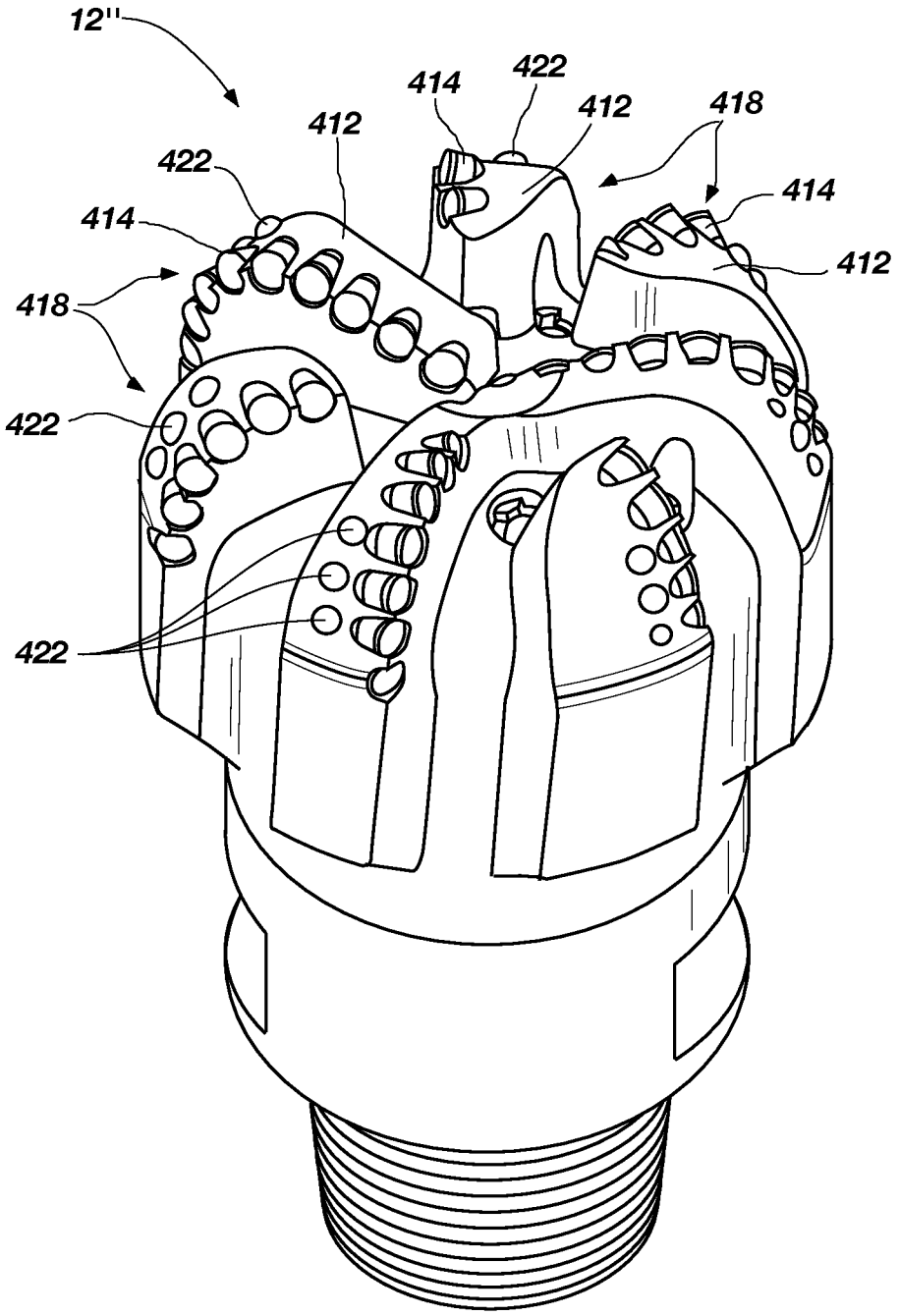
FIG. 8 is a perspective view of another embodiment of a pilot drill bit that may be used as part of the bottom hole assembly of FIG. 1.
Figure 9:
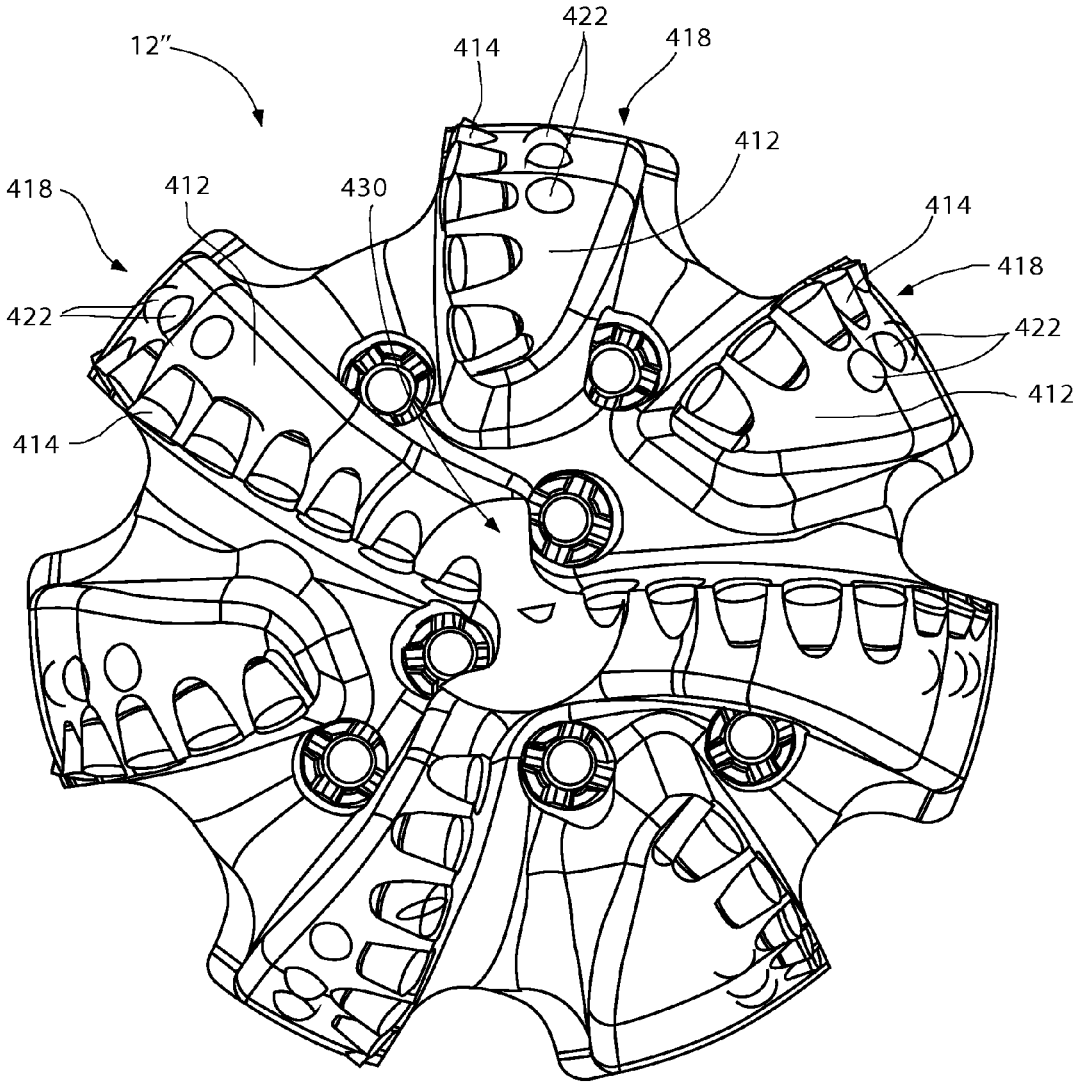
FIG. 9 is a plan view of the face the pilot drill bit shown in FIG. 8.
Figure 10:
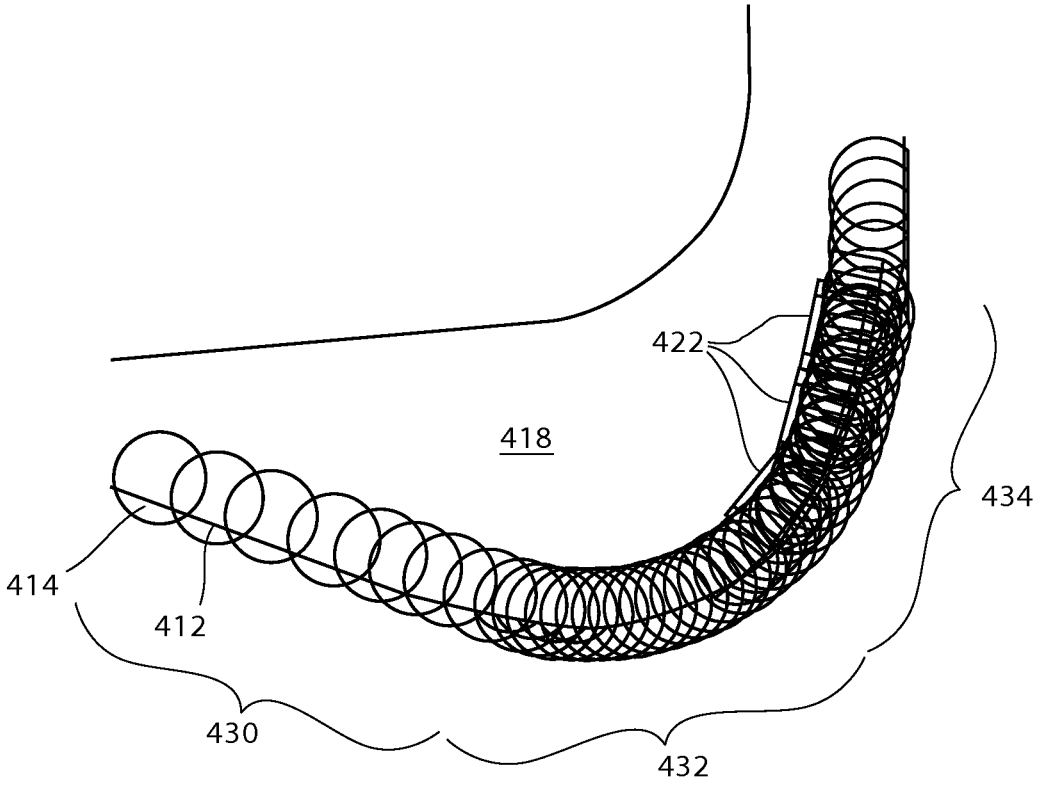
FIG. 10 illustrates a cutter profile of the drill bit shown in FIGS. 8 and 9.

FIGS. 8 through 10 illustrate yet another embodiment of a pilot drill bit 12" that may be used in the bottom hole assembly 10 of FIG. 1 and that includes a plurality of cutters 414 bonded by their substrates (diamond tables and substrates not shown separately for clarity), as by brazing, into pockets in blades 418 extending above a face 412 of the pilot drill bit 12". FIG. 8 is a perspective view of the pilot drill bit 12". FIG. 9 is a plan view of the face 412 of the pilot drill bit 12", and FIG. 10 is a cutter profile diagram of the pilot drill bit 12" illustrating each of the cutters 414 as if they had been rotated around a longitudinal axis of the pilot drill bit 12" into a common plane.

Referring to FIGS. 9 and 10, cutters 414 fixedly attached to the pilot drill bit 12" in a radially inward cone region 430 on the face 412 of the pilot drill bit 12" may exhibit a reduced cutter exposure relative to cutters 414 fixedly attached to the pilot drill bit 12" in a radially outward nose region 432 and/or shoulder region 434 on the face 412 of the pilot drill bit 12". By reducing the exposure of the cutters 414 in the cone region 430 of the pilot drill bit 12", the average depth-of-cut of the cutters 414 of the pilot drill bit 12" into a formation may be limited to a predetermined maximum average depth-of-cut of the cutters 414 that is determined by the exposure of the cutters 414 in the cone region 430. In other words, as the cutters 414 of the pilot drill bit 12" penetrate into a formation, the cutters 414 in the cone region 430 may penetrate into the formation to a depth at which the areas of the surfaces of the blades 418 contact the surface of the formation. As those areas of the surfaces of the blades 418 (i.e., from the face 412) in the cone region 430 ride on the formation as the pilot drill bit 12" is rotated in the wellbore, the physical contact between the surfaces of the blades 418 and the formation will prevent further penetration of the cutters 414 into the formation, effectively limiting the average depth-of-cut of the cutters 414 to a maximum average depth-of-cut that is predetermined by the distance the cutters 414 in the cone region 430 project outward from the surfaces of the blades 418 in the cone region 430.

The pilot drill bit 12" also my include DOCC features in the form of tungsten carbide inserts 422 positioned in a shoulder region 434 on the face 412 of the pilot drill bit 12". As shown in FIG. 10, each tungsten carbide insert 422 may be positioned at the same radial and longitudinal position as at least one cutter 414 (but at a different circumferential position about the longitudinal axis of the pilot drill bit 12"). Each tungsten carbide insert 422 may be configured to bear on the surface of a formation as the pilot drill bit 12" is utilized to drill a subterranean formation. The tungsten carbide inserts 422 may be configured (e.g., sized and positioned) to limit an exposure of at least the corresponding cutters 414. As a result, the tungsten carbide inserts 422 may be used to limit an average depth-of-cut of the cutters 414 to a predetermined maximum average depth-of-cut.

The total rubbing surface area of the DOCC features of any particular pilot drill bit will at least partially depend on the size of the pilot drill bit (i.e., the total surface area of the face of the pilot drill bit. By way of example only, the total rubbing surface area of the DOCC features of a pilot drill bit generally configured as shown in any one of FIGS. 2, 4, and 8 through 10 may be between about 0.5% and about 50.0% of a projected area $A_P$ of the pilot drill bit, wherein the projected area $A_P$ of the pilot drill bit is defined as the area of a circle having a diameter equal to a gage diameter D of the pilot drill bit. More particularly, the total rubbing surface area of the DOCC features of a pilot drill bit generally configured as shown in any one of FIGS. 2, 4, and 8 through 10 may be between about 1.0% and about 10% of the projected area $A_P$ of the pilot drill bit. As a non-limiting example, a sixteen inch (16") (about 40.6 cm) pilot drill bit (i.e., a pilot drill bit having a gage diameter D of 16" (about 40.6 cm)) has a projected area $A_P$ of about 201 square inches (about 1,297 $cm^2$) ($A_P=\pi(16/2)^2$), and the total rubbing surface area of the DOCC features on such a drill bit may be between about one square inch (1 sq. in.) (about 6.5 $cm^2$) and about one hundred square inches (100 sq. in.) (about 645 $cm^2$). More particularly, the total rubbing surface area of the DOCC features on such a drill bit may be between about two square inches (2 sq. in.) (about 13 $cm^2$) and about twenty square inches (20 sq. in.) (about 129 $cm^2$).

Additionally, the aggressiveness of the pilot drill bit 12, 12', 12" may also be selectively tailored by changing one or more variable features, provided as non-limiting examples, such as the orientation of the cutters 114, 214, 414 (e.g., the back rake angle), the cutter 114, 214, 414 exposure (i.e., above the bit face), the cutter 114, 214, 414 sizes (e.g., the diameter), the cutter 114, 214, 414 spacing (e.g., the distance between cutters 114, 214, 414), the number of cutters 114, 214, 414, the sharpness (e.g., chamfer, edge roundness, corner angle, edge geometry) of the cutters 114, 214, 414, the size of the bearing surfaces 130*a*-130*f*, 230*a*-230*f* (e.g., the number and size of DOCC features), the number of blades 118, 218, 418, the rotational speed (i.e., angular velocity, rotations per minute (RPM)) while drilling, the pilot drill bit 12, 12', 12" type (e.g., rolling-cutter, drag, hybrid, etc.), and combinations thereof.

The reamer device 14 of the bottom hole assembly 10 may comprise, for example, a reamer device as disclosed in at least one of U.S. Patent Application Publication No. US 2008/0128175 A1 by Radford et al., which published Jun. 5, 2008, now U.S. Pat. No. 7,900,717, issued Mar. 8, 2011, and U.S. Patent Application Publication No. US2008/0128174 A1 by Radford et al., which published Jun. 5, 2008, now U.S. Pat. No. 7,997,354, issued Aug. 16, 2011, the disclosure of each of which is incorporated by reference herein in its entirety.

The reamer device 14 may comprise cutters fixedly attached to wings or blades on the reamer device 14, and the depth-of-cut of the fixed cutters on the wings or blades of the reamer device 14 optionally may be selectively controlled by providing rubbing or bearing structures on the outer surfaces of the wings or blades in the same manners and configurations as described in U.S. Pat. No. 6,298,930 to Sinor et al. and U.S. Pat. No. 6,460,631 to Dykstra et al. with respect to rotary drill bits.

Figure 5:
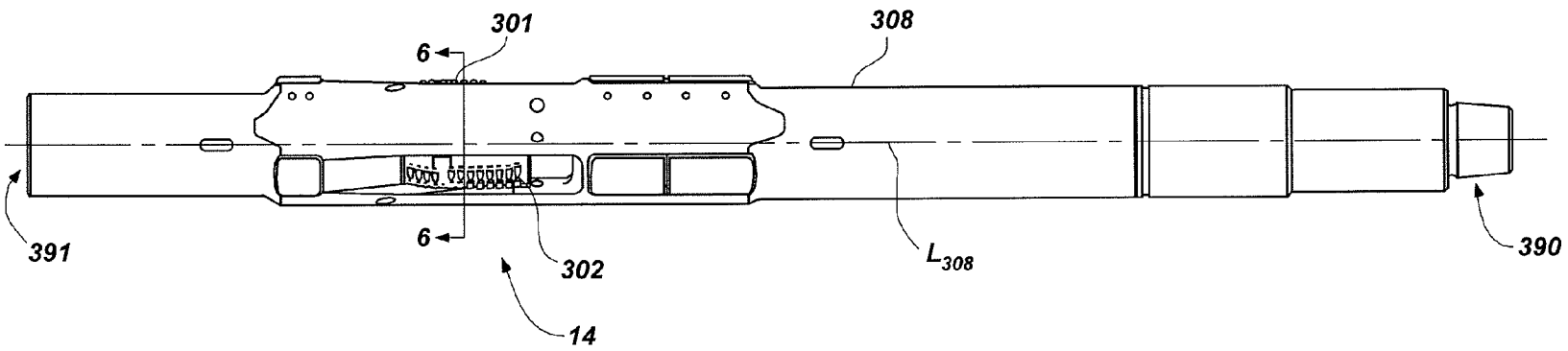
FIG. 5 is a side plan view of an embodiment of a reamer device that may be used as part of the bottom hole assembly of FIG. 1.

An embodiment of an expandable reamer device 14 that may be used in the bottom hole assembly 10 of FIG. 1 is illustrated in FIG. 5. The expandable reamer device 14 may include a generally cylindrical tubular body 308 having a longitudinal axis $L_{308}$. The tubular body 308 of the expandable reamer device 14 may have a lower end 390 and an upper end 391. The terms "lower" and "upper," as used herein with reference to the ends 390, 391, refer to the typical positions of the ends 390, 391 relative to one another when the expandable reamer device 14 is positioned within a wellbore. The lower end 390 of the tubular body 308 of the expandable reamer device 14 may include a set of threads (e.g., a threaded male pin member) for connecting the lower end 390 to another section or component of the bottom hole assembly 10 (FIG. 1). Similarly, the upper end 391 of the tubular body 308 of the expandable reamer device 14 may include a set of threads (e.g., a threaded female box member) for connecting the upper end 391 to a section of a drill string or another component of the bottom-hole assembly 10 (FIG. 1).

Three sliding cutter blocks or blades 301, 302, 303 (see FIG. 6) are positionally retained in circumferentially spaced relationship in the tubular body 308 as further described below and may be provided at a position along the expandable reamer device 14 intermediate the first lower end 390 and the second upper end 391. The blades 301, 302, 303 may be comprised of steel, tungsten carbide, a particle-matrix composite material (e.g., hard particles dispersed throughout a metal matrix material), or other suitable materials as known in the art. The blades 301, 302, 303 are movable between a retracted position, in which the blades are retained within the tubular body 308 of the expandable reamer device 14, and an extended or expanded position in which the blades project laterally from the tubular body 308. The expandable reamer device 14 may be configured such that the blades 301, 302, 303 engage the walls of a subterranean formation surrounding a wellbore in which bottom hole assembly 10 (FIG. 1) is disposed to remove formation material when the blades 301, 302, 303 are in the extended position, but are not operable to so engage the walls of a subterranean formation within a wellbore when the blades 301, 302, 303 are in the retracted position. While the expandable reamer device 14 includes three blades 301, 302, 303, it is contemplated that one, two or more than three blades may be utilized. Moreover, while the blades 301, 302, 303 are symmetrically circumferentially positioned axial along the tubular body 308, the blades may also be positioned circumferentially asymmetrically, and also may be positioned asymmetrically along the longitudinal axis $L_{308}$ in the direction of either end 390 and 391.

Figure 6:
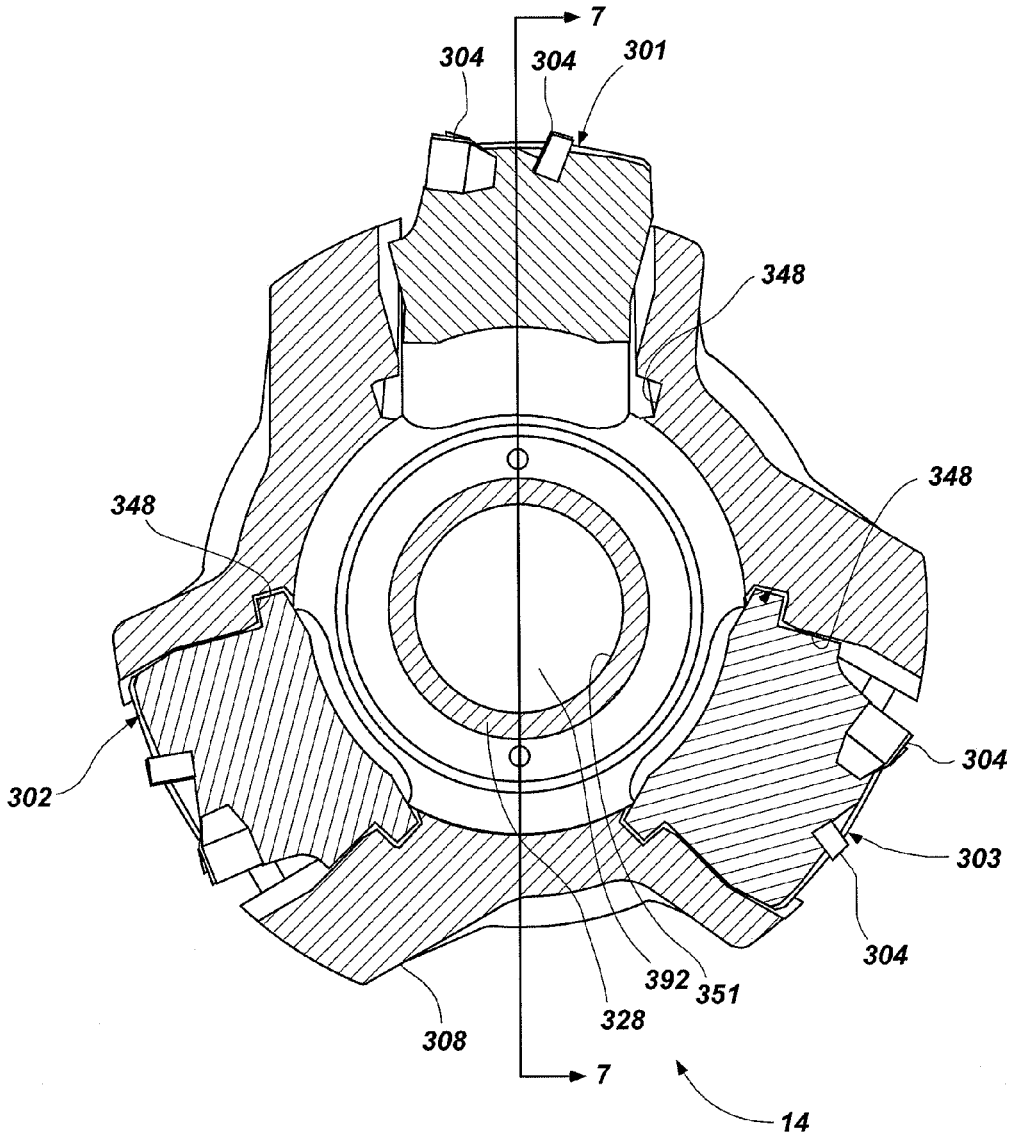
FIG. 6 is a cross-sectional view of the reamer device shown in FIG. 5 taken along section line 6-6 shown in FIG. 5.

FIG. 6 is a cross-sectional view of the expandable reamer device 14 shown in FIG. 5 taken along section line 6-6 shown therein. As shown in FIG. 6, the tubular body 308 encloses a fluid passageway 392 that extends longitudinally through the tubular body 308. The fluid passageway 392 directs fluid substantially through an inner bore 351 of a traveling sleeve 328 in bypassing relationship to substantially shield the blades 301, 302, 303 from exposure to drilling fluid, particularly in the lateral direction, or normal to the longitudinal axis $L_{308}$. A push sleeve 315 (FIG. 7) may be configured to actuate the blades 301, 302, 303 in response to controlled fluid flow through the reamer device 14, as described herein below.

With continued reference to FIG. 6, the blades 302 and 303 are shown in the initial or retracted positions, while blade 301 is shown in the outward or extended position. The expandable reamer device 14 may be configured such that the outermost radial or lateral extent of each of the blades 301, 302, 303 is recessed within the tubular body 308 when in the initial or retracted positions so it may not extend beyond the greatest extent of outer diameter of the tubular body 308. Such an arrangement may protect the blades 301, 302, 303 as the expandable reamer device 14 is disposed within a casing of a borehole, and may allow the expandable reamer device 14 to pass through such casing within a borehole. In other embodiments, the outermost radial extent of the blades 301, 302, 303 may coincide with or slightly extend beyond the outer diameter of the tubular body 308. As illustrated by blade 301, the blades may extend beyond the outer diameter of the tubular body 308 when in the extended position, to engage the walls of a borehole in a reaming operation.

Figure 7:
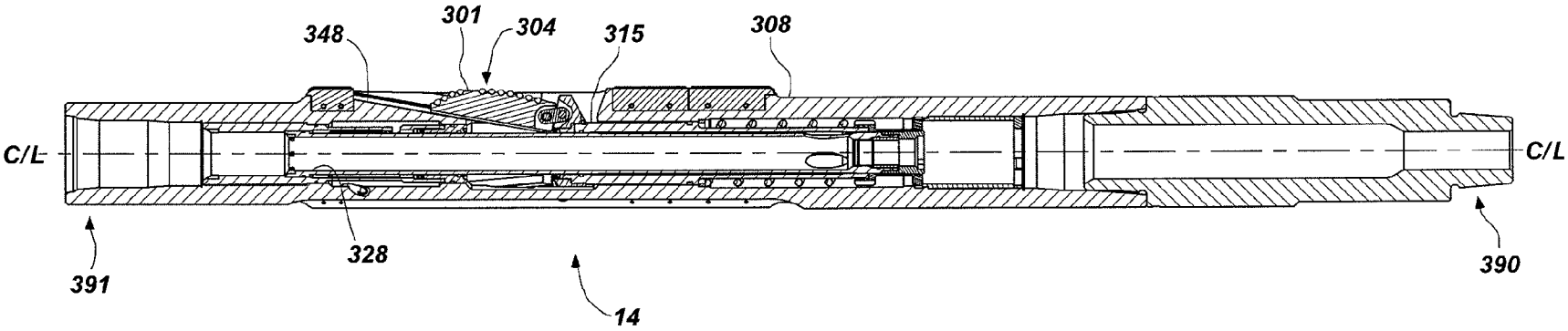
FIG. 7 is a longitudinal cross-sectional view of the reamer device shown in FIGS. 5 and 6 taken along section line 7-7 shown in FIG. 6.

FIG. 7 is another cross-sectional view of the expandable reamer device 14 shown in FIGS. 5 and 6 taken along section line 7-7 shown in FIG. 6. The tubular body 308 respectively retains three sliding cutter blocks or blades 301, 302, 303 in three blade tracks 348. The blades 301, 302, 303 each carry a plurality of cutters 304 for engaging the material of a subterranean formation defining the wall of an open bore hole when the blades 301, 302, 303 are in an extended position. The cutters 304 may be polycrystalline diamond compact (PDC) cutters or other cutting elements.

The construction and operation of the expandable reamer device 14 shown in FIGS. 5 through 7 is described in further detail in the previously mentioned U.S. Patent Application Publication No. US 2008/0128175 A1 by Radford et al., which published Jun. 5, 2008, now U.S. Pat. No. 7,900,717, issued Mar. 8, 2011.

As previously described herein, the embodiments of drilling tool assemblies, such as the bottom hole assembly 10 of FIG. 1, may include a pilot drill bit and a reamer device that are configured to distribute a weight-on-bit to be applied to the drilling tool assembly between the pilot drill bit and the reamer device so as to maintain a ratio of the portion of the weight-on-bit to be applied to the reamer device to a portion of the weight-on-bit to be applied to the pilot drill bit within a predetermined range.

A plurality of cutters fixedly attached to the pilot drill bit may be sized and configured to exhibit a first average exposure, and a plurality of cutters fixedly attached to the reamer device may be sized and configured to exhibit a second average exposure that is greater than the first average exposure of the plurality of cutters of the pilot drill bit. In some embodiments, the second average exposure may be greater than about 1.2 times the first average exposure, or more particularly, greater than about 1.5 times the first average exposure.

The pilot drill bit and the reamer device may be configured to desirably distribute the weight-on-bit between the pilot drill bit and the reamer device in various ways. For example, in some embodiments, cutters fixedly attached to a pilot drill bit in a cone region on a face of the pilot drill bit may exhibit a reduced cutter exposure relative to cutters fixedly attached to the pilot drill bit in a shoulder region on the face of the pilot drill bit. As an additional example, the pilot drill bit may include at least one bearing structure (i.e., a DOCC feature) projecting from a face of the pilot drill bit and sized and configured to limit a depth-of-cut of cutters fixedly attached to the pilot drill bit to a maximum average depth-of-cut by bearing on a surface of a formation to be drilled by the drilling tool.

The reamer device also may include at least one such bearing structure. In such embodiments, the bearing structure or structures on one or more blades of the reamer device may be sized and configured to limit an average depth-of-cut of the cutters of the reamer device to a predetermined maximum average depth-of-cut that is greater than a predetermined maximum average depth-of-cut of a plurality of cutters on the pilot drill bit.

In some embodiments, a maximum average depth-of-cut of a plurality of cutters of a pilot drill bit may be less than an average exposure of a plurality of cutters fixedly attached to a plurality of blades of the reamer device.

Additionally, the aggressiveness of the reamer device 14 may also be selectively tailored by changing one or more variable features, provided as non-limiting examples, such as the orientation of the cutters 304 (e.g., the back rake angle), the cutters 304 exposure (i.e., relative to the blade faces), the cutters 304 sizes (e.g., the diameter), the cutters 304 spacing (e.g., the distance between cutters 304), the number of cutters 304, the sharpness (e.g., chamfer, edge roundness, corner angle, edge geometry) of the cutters 304, the size of any bearing surfaces (e.g., the number and size of DOCC features), the number of blades 301, 302, 303, the rotational speed (i.e., angular velocity, rotations per minute (RPM)) while reaming, the reamer device 14 type (e.g., rolling-cutter, drag, hybrid, etc.), and combinations thereof.

Embodiments of drilling systems and drilling tool assemblies disclosed herein may be used to drill wellbores in subterranean formations. For example, a pilot bore may be drilled through a first relatively harder formation material and into a second relatively softer formation material using a pilot drill bit of a bottom hole assembly. The pilot bore may be reamed in the first relatively harder formation using a reamer device of the bottom hole assembly while the pilot drill bit continues to drill into the second relatively softer formation material. A weight-on-bit applied to the bottom hole assembly may be selectively distributed between the pilot drill bit and the reamer device. For example, the ratio of the weight on the reamer to the weight on the pilot bit may be maintained at about 0.5:1 or less. More particularly, the ratio may be maintained between about 0.1:1 and about 0.4:1.

In some embodiments, as a wellbore is drilled in accordance with such methods, the relatively softer formation material may be engaged with cutters on the pilot drill bit to a selected average depth-of-cut, and the selected average depth-of-cut may be maintained as a portion of the weight-on-bit to the pilot drill bit is applied in excess of a smaller portion of the weight-on-bit required for the plurality of cutters to penetrate the second relatively softer formation material to the selected average depth-of-cut.

Such methods may be conducted in geological formations in which the second relatively softer formation material exhibits an unconfined compressive strength that is less than about 80%, or even less than about 50%, of the unconfined compressive strength exhibited by the relatively harder formation material. Again, embodiments may also be employed in homogeneous formations.

A plurality of cutters on the pilot drill bit may be sized and configured to exhibit a first average exposure on the pilot drill bit, and a plurality of cutters on the reamer device may be sized and configured to exhibit a second average exposure on the reamer device that is greater than the first average exposure. In some embodiments, the second average exposure of the plurality of cutters on the reamer device may be selected to be greater than about 1.2 times the first average exposure of the plurality of cutters on the pilot drill bit. More particularly, the second average exposure of the plurality of cutters on the reamer device may be selected to be greater than about 1.5 times the first average exposure of the plurality of cutters on the pilot drill bit.

By way of example, an exposure of cutters fixedly attached to an inner cone region on a face of a pilot drill bit may be reduced relative to cutters fixedly attached to a nose region and/or a shoulder region on the face of the pilot drill bit. As another example, an exposure of cutters fixedly attached to an inner cone region and a nose region on a face of a pilot drill bit may be reduced relative to cutters fixedly attached to a shoulder region on the face of the pilot drill bit. In addition or as an alternative, at least one raised bearing feature (e.g., a DOCC feature) may be provided on and project from the face of the pilot drill bit. Furthermore, although certain techniques are described in detail hereinabove, it is contemplated that various techniques may be used to configure the pilot drill bit and the reamer device to selectively distribute a weight-on-bit therebetween including, for example, increasing the number of blades on the pilot bit, increasing the number of cutters on the pilot bit, reducing an average depth-of-cut of the cutters on the pilot bit, reducing an average size of the cutters on the pilot bit, increasing the back rake angle of the cutters of the pilot bit, decreasing the cutter exposure on the pilot bit, increasing the cutter spacing on the pilot bit, increasing the chamfer size or edge roundness of the cutters on the pilot bit, increasing the size of the bearing surface on the pilot bit, reducing the relative rotational speed of the pilot bit, selecting a less aggressive pilot bit type (e.g., a rolling-cutter or hybrid bit type), and a combination of one or more of these techniques, etc.

Embodiments may be utilized to distribute a weight-on-bit in a desirable manner between a pilot bit and a reamer device of a bottom hole assembly when drilling through homogeneous subterranean formations, as well as when drilling through different subterranean formations having different physical properties and characteristics.

EXAMPLE

A bottom hole assembly 10 like that shown in FIG. 1 was used to drill a wellbore as described in I. Thomson et al., "A Systematic Approach to a Better Understanding of the Concentric Hole-Opening Process Utilizing Drilling Mechanics and Drilling Dynamics Measurements Recorded Above and Below the Reamer," International Association of Drilling Contracts (IADC) and Society of Petroleum Engineers (SPE) Paper No. IADC/SPE 112647 (2008), which was prepared for presentation at the 2008 IADC/SPE Drilling Conference held in Orlando, Fla., U.S.A., between Mar. 4, 2008 and Mar. 6, 2008, which is incorporated by reference herein in its entirety. The bottom hole assembly 10 resulting in improved performance and reduced downhole vibrations relative to a previously known bottom hole assembly configuration.

Although the foregoing description contains many specifics, these are not to be construed as limiting the scope of the present invention, but merely as providing certain exemplary embodiments. Similarly, other embodiments of the invention may be devised within the scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are encompassed by the present invention.

What is claimed is:

1. A drilling tool assembly comprising:

a pilot drill bit; and a reamer device assembled in a bottom hole assembly at a fixed distance relative to the pilot drill bit;

wherein the pilot drill bit and the reamer device are configured to distribute a weight-on-bit to be applied to the drilling tool assembly between the pilot drill bit and the reamer device so as to maintain a ratio of a portion of the weight-on-bit to be applied to the reamer device to a portion of the weight-on-bit to be applied to the pilot drill bit within a predetermined range between about 0.1:1 and about 0.5:1.

2. The drilling tool assembly of claim 1, wherein the pilot drill bit comprises a plurality of cutters fixedly attached to the pilot drill bit, the plurality of cutters fixedly attached to the pilot drill bit being sized and configured to exhibit a first average exposure, and wherein the reamer device comprises a plurality of cutters fixedly attached to the reamer device, the plurality of cutters fixedly attached to the reamer device being sized and configured to exhibit a second average exposure greater than about 1.2 times the first average exposure of the plurality of cutters of the pilot drill bit.

3. The drilling tool assembly of claim 2, wherein the second average exposure is greater than about 1.5 times the first average exposure.

4. The drilling tool assembly of claim 2, wherein cutters of the plurality of cutters fixedly attached to the pilot drill bit in a cone region on a face of the pilot drill bit exhibit a reduced cutter exposure relative to cutters of the plurality of cutters fixedly attached to the pilot drill bit in a shoulder region on the face of the pilot drill bit.

5. The drilling tool assembly of claim 2, wherein the pilot drill bit comprises at least one bearing structure projecting from a face of the pilot drill bit and sized and configured to limit a depth-of-cut of the plurality of cutters fixedly attached to the pilot drill bit to a maximum average depth-of-cut of the plurality of cutters fixedly attached to the pilot drill bit by bearing on a surface of a formation to be drilled by the drilling tool.

6. The drilling tool assembly of claim 1, wherein the pilot drill bit comprises:

a plurality of cutters fixedly mounted on a plurality of blades of the pilot drill bit; and at least one bearing structure on at least one blade of the plurality of blades, the at least one bearing structure sized and configured to limit an average depth-of-cut of the plurality of cutters to a predetermined maximum average depth-of-cut of the plurality of cutters.

7. The drilling tool assembly of claim 6, wherein the maximum average depth-of-cut of the plurality of cutters of the pilot drill bit is less than an average exposure of a plurality of cutters fixedly attached to a plurality of blades of the reamer device.

8. The drilling tool assembly of claim 6, wherein the reamer device further comprises at least one bearing structure on at least one blade of the plurality of blades of the reamer device, the at least one bearing structure of the reamer device sized and configured to limit an average depth-of-cut of the plurality of cutters of the reamer device to a predetermined maximum average depth-of-cut of the plurality of cutters of the reamer device that is greater than the predetermined maximum average depth-of-cut of the plurality of cutters of the pilot drill bit.

9. The drilling tool assembly of claim 1, wherein the reamer device comprises a plurality of cutters fixedly attached to each of a plurality of blades.

10. The drilling tool assembly of claim 9, wherein the blades of the plurality of blades are moveable between a first laterally retracted position and a second laterally expanded position.

11. The drilling tool assembly of claim 1, wherein the pilot drill bit comprises one of a fixed-cutter rotary drill bit, a rolling-cutter rotary drill bit, and a hybrid rotary drill bit including at least one fixed-cutter and at least one rolling-cutter.

12. The drilling tool assembly of claim 1, wherein the pilot drill bit is less aggressive than the reamer device.

13. The drilling tool assembly of claim 12, wherein cutters of the pilot drill bit have an average back rake angle that is greater than an average back rake angle of cutters of the reamer device.

14. The drilling tool assembly of claim 12, wherein cutters of the pilot drill bit have an average size that is less than an average size of cutters of the reamer device.

15. The drilling tool assembly of claim 12, wherein the pilot drill bit has more cutters per unit of projected area than the reamer device.

16. The drilling tool assembly of claim 12, wherein cutters of the pilot drill bit have an average chamfer size that is greater than an average chamfer size of cutters of the reamer device.

17. The drilling tool assembly of claim 12, wherein the pilot drill bit has more blades than the reamer device.

18. A method of drilling a wellbore in a subterranean formation, comprising:

drilling a pilot bore through a first relatively harder formation material and into a second relatively softer formation material using a pilot drill bit of a bottom hole assembly;

reaming the pilot bore in the first relatively harder formation using a reamer device of the bottom hole assembly while the pilot drill bit continues to drill into the second relatively softer formation material, wherein the pilot drill bit and the reamer device are assembled in the bottom hole assembly at a fixed distance relative to one another; and selectively distributing a weight-on-bit applied to the bottom hole assembly between the pilot drill bit and the reamer device while maintaining a ratio of a portion of the weight-on-bit applied to the reamer device to a portion of the weight-on-bit applied to the pilot drill bit within a predetermined range between about 0.1:1 and about 0.5:1.

19. The method of claim 18, wherein drilling the pilot bore through the first relatively harder formation material and into the second relatively softer formation material comprises drilling the pilot bore through a formation material exhibiting a first average unconfined compressive strength into a second formation material exhibiting a second average unconfined compressive strength that is less than about 80% of the first average unconfined compressive strength.

20. The method of claim 18, further comprising maintaining the ratio of the portion of the weight-on-bit applied to the reamer device to a portion of the weight-on-bit applied to the pilot drill bit within a predetermined range between about 0.1:1 and about 0.5:1 as the pilot drill bit and the reamer device are advanced through the first relatively harder formation material and into the second relatively softer formation material.

21. The method of claim 20, further comprising maintaining the ratio of the portion of the weight-on-bit applied to the reamer device to a portion of the weight-on-bit applied to the pilot drill bit between about 0.1:1 and about 0.4:1 as the pilot drill bit and the reamer device are advanced through the first relatively harder formation material and into the second relatively softer formation material.

22. The method of claim 20, further comprising:

sizing and configuring a plurality of cutters on the pilot drill bit to exhibit a first average exposure on the pilot drill bit; and sizing and configuring a plurality of cutters on the reamer device to exhibit a second average exposure on the reamer device that is greater than the first average exposure.

23. The method of claim 22, further comprising selecting the second average exposure of the plurality of cutters on the reamer device to be greater than about 1.2 times the first average exposure of the plurality of cutters on the pilot drill bit.

24. The method of claim 23, further comprising selecting the second average exposure of the plurality of cutters on the reamer device to be greater than about 1.5 times the first average exposure of the plurality of cutters on the pilot drill bit.

25. The method of claim 22, wherein sizing and configuring a plurality of cutters on the pilot drill bit to exhibit a first average exposure comprises reducing an exposure of cutters of the plurality of cutters fixedly attached to an inner cone region on a face of the pilot drill bit relative to cutters of the plurality of cutters fixedly attached to a shoulder region on the face of the pilot drill bit.

26. The method of claim 22, wherein sizing and configuring a plurality of cutters on the pilot drill bit to exhibit a first average exposure on the pilot drill bit comprises providing at least one raised bearing feature projecting from a face of the pilot drill bit.

27. The method of claim 18, further comprising:

engaging the second relatively softer formation material with a plurality of cutters on the pilot drill bit to a selected average depth-of-cut; and maintaining the selected average depth-of-cut during application of a portion of the weight-on-bit to the pilot drill bit in excess of a smaller portion of the weight-on-bit required for the plurality of cutters to penetrate the second relatively softer formation material to the selected average depth-of-cut by providing a bearing area on the pilot drill bit.

28. A method of drilling a wellbore in a subterranean formation, comprising:

configuring a reamer device of a bottom hole assembly to exhibit a first maximum rate-of-penetration into a first relatively harder formation material when a selected weight-on-bit and a selected torque are applied to the bottom hole assembly;

configuring a pilot drill bit of the bottom hole assembly to exhibit a second maximum rate-of-penetration into a second relatively softer formation material when the selected weight-on-bit and the selected torque are applied to the bottom hole assembly, the second maximum rate-of-penetration being less than the first maximum rate-of-penetration, wherein the reamer device and the pilot drill bit are assembled in the bottom hole assembly at a fixed distance relative to one another;

positioning the bottom hole assembly into the wellbore and applying the selected weight-on-bit and the selected torque to the bottom hole assembly;

drilling a pilot bore through the first relatively harder formation material and into the second relatively softer formation material using the pilot drill bit of the bottom hole assembly;

reaming the pilot bore in the first relatively harder formation using the reamer device of the bottom hole assembly while the pilot drill bit continues to drill into the second relatively softer formation material; and maintaining a ratio of a portion of the weight-on-bit applied to the reamer device to a portion of the weight-on-bit applied to the pilot drill bit within a predetermined range between about 0.1:1 and about 0.5:1.

29. The method of claim 28, wherein drilling the pilot bore through the first relatively harder formation material and into the second relatively softer formation material comprises drilling the pilot bore through a formation material exhibiting a first average unconfined compressive strength into a second formation material exhibiting a second average unconfined compressive strength that is less than about 80% of the first average unconfined compressive strength.

30. The method of claim 29, wherein configuring the pilot drill bit of the bottom hole assembly to exhibit the second maximum rate-of-penetration into the second relatively softer formation material comprises reducing an exposure of a plurality of cutters fixedly attached to an inner cone region on a face of the pilot drill bit relative to a plurality of cutters fixedly attached to a shoulder region on the face of the pilot drill bit.

31. The method of claim 28, further comprising:

limiting an average depth-of-cut of a plurality of cutters on the pilot drill bit to a predetermined maximum average depth-of-cut;

limiting an average depth-of-cut of a plurality of cutters on the reamer device to a predetermined maximum average depth-of-cut; and selecting the predetermined maximum average depth-of-cut of the plurality of cutters on the reamer device to be greater than the predetermined maximum average depth-of-cut of the plurality of cutters on the pilot drill bit.

32. The method of claim 31, further comprising selecting the predetermined maximum average depth-of-cut of the plurality of cutters on the reamer device to be greater than about 1.2 times the predetermined maximum average depth-of-cut of the plurality of cutters on the pilot drill bit.

33. The method of claim 32, further comprising selecting the predetermined maximum average depth-of-cut of the plurality of cutters on the reamer device to be greater than about 1.5 times the predetermined maximum average depth-of-cut of the plurality of cutters on the pilot drill bit.

34. The method of claim 31, wherein limiting the average depth-of-cut of the plurality of cutters on the pilot drill bit to the predetermined maximum average depth-of-cut comprises reducing an exposure of cutters of the plurality fixedly attached to an inner cone region on a face of the pilot drill bit relative to cutters of the plurality fixedly attached to a shoulder region on the face of the pilot drill bit.

35. The method of claim 31, wherein limiting the average depth-of-cut of the plurality of cutters on the pilot drill bit to the predetermined maximum average depth-of-cut comprises providing at least one raised bearing feature projecting from a face of the pilot drill bit.

* * * * *